US005088312A

United States Patent [19]

Lange

[11] Patent Number: 5,088,312

[45] Date of Patent: Feb. 18, 1992

[54] UPSETTING DEVICE FOR UPSETTING THE ENDS OF ELONGATED WORKPIECES SUCH AS WIRE PIECES

[75] Inventor: Gerhard Lange, Reutlingen/Württ., Fed. Rep. of Germany

[73] Assignee: WAFIOS Maschinenfabrik GmbH & Co., Fed. Rep. of Germany

[21] Appl. No.: 535,059

[22] Filed: Jun. 8, 1990

[30] Foreign Application Priority Data

Jul. 8, 1989 [DE] Fed. Rep. of Germany ..... 3922531

[51] Int. Cl.[5] ..... B21J 13/10; B21G 3/20

[52] U.S. Cl. ..... 72/420; 10/44; 10/11 T

[58] Field of Search ..... 10/11 A, 11 T, 12 R, 10/12 T, 12.5, 15, 26, 30, 49, 57, 44; 72/318, 373, 428, 441, 442, 420, 421

[56] References Cited

U.S. PATENT DOCUMENTS

| | | | |
|---|---|---|---|
| 122,385 | 1/1872 | Hunter | 10/26 X |
| 382,632 | 5/1888 | Bancroft et al. | 10/49 |
| 1,109,856 | 9/1914 | McCarroll | 72/442 X |
| 1,112,544 | 10/1914 | McCarroll | 72/442 X |
| 1,146,957 | 7/1915 | Roach | 10/49 |
| 2,595,433 | 5/1952 | Wilcox et al. | 10/12.5 |
| 3,017,984 | 1/1962 | Willard et al. | 72/421 X |
| 3,301,033 | 1/1967 | Bignell et al. | 10/49 X |
| 3,514,992 | 6/1970 | Braun et al. . | |
| 3,588,933 | 6/1971 | Shinopulos et al. . | |
| 4,270,651 | 6/1981 | Ragard et al. . | |
| 4,737,227 | 4/1988 | Foster et al. . | |

FOREIGN PATENT DOCUMENTS

| | | | |
|---|---|---|---|
| 49164 | 10/1889 | Fed. Rep. of Germany . | |
| 7103385 | 3/1950 | Fed. Rep. of Germany . | |
| 3805628 | 2/1988 | Fed. Rep. of Germany . | |
| 742013 | 6/1980 | U.S.S.R. | 10/44 |

OTHER PUBLICATIONS

The Heavy Industry of Czechoslowakia, "Czechoslowakian Nail Automats", J. Glaser, Issue 12/1964, pp. 34–43; Fig. 9 on p. 40.

*Primary Examiner*—Lowell A. Larson
*Assistant Examiner*—Michael J. McKeon
*Attorney, Agent, or Firm*—Wigman & Cohen

[57] ABSTRACT

An upsetting device for upsetting the ends of elongated workpieces such as wire pieces and the use of such a device in a wire-working nail press. The device includes an upsetting tool moveable forwards and backwards by means of an upsetting carriage. The upsetting tool is separate from the upsetting carriage and mounted to be displaceable in its direction of movement in its own longitudinal guide separately from the carriage guide. The upsetting tool also positively bears against the part of the upsetting carriage which acts on it.

2 Claims, 2 Drawing Sheets

UPSETTING DEVICE FOR UPSETTING THE ENDS OF ELONGATED WORKPIECES SUCH AS WIRE PIECES

CROSS REFERENCES TO RELATED APPLICATIONS

This application is subject matter related to commonly assigned copending U.S. application Ser. No. 544,928 for "Conveyor Device for Transporting Elongated Workpieces such as Wire Pieces and the Use of such a Device in a Wireworking Nail Press," filed concurrently herewith.

BACKGROUND OF THE INVENTION

1. Field of the Invention

This invention relates to an upsetting device for upsetting the ends of elongated workpieces such as wire pieces, and more particularly for such an upsetting device used for the production of heads on nails.

2. Description of the Prior Art

The state of the art includes upsetting devices having an upsetting tool which is displaceable forwards and backwards by means of a carriage to which it is connected for continuous conjoint movement.

It is already known to construct the upsetting device of an apparatus for the production of wire nails in such a manner that the upsetting tool operates with a short stroke. In such an arrangement, the upsetting action on the head of the wire nail may be derived either from a short stroke crank shaft or from a short stroke cam disc by way of an upsetting carriage. This arrangement has the advantage that a greater length of time is available for shaping the head than in long stroke constructions, with the result that the speed of deformation and the resistance to deformation can be reduced. A softer transition is obtained in the upsetting process without alteration to the operating cycle in the coupling members and the noise level of the machine is therefore reduced.

Short stroke constructions have, however, the disadvantage that owing to the short excursion of the upsetting tool, there is only a very small distance between the clamping jaws which serve as anvil and grip the wire during upsetting of the head and the upsetting tool when the upsetting carriage is in the withdrawn position.

The disadvantage of this connection in short stroke constructions of the carriage is that insufficient space for a tool change is available between the upsetting tool and the workpiece to be upset even when the upsetting tool is withdrawn so that it has hitherto been necessary to dismantle the clamping tools provided for holding the workpiece and then to reassemble them.

In other words, it has hitherto always been necessary to remove the entire box containing the clampinq jaw whenever the upsetting tools, and especially the clamping tools have had to be replaced due to wear and tear or due to a change in the diameter of the wires to be processed.

OBJECTS AND SUMMARY OF THE INVENTION

It is therefore an object of the present invention to provide a short stroke upsetting device in which only a small number of lightweight parts need to be removed for replacement of the tools in the event of a change in the diameter of the wires to be processed or when the tools are worn out. It is also an object of the invention to provide such a device which is more precise and quieter in operation and requires less servicing.

Briefly described, and proceeding from a device of the type defined above, this problem is solved according to the invention by providing an upsetting tool which is mounted in its own longitudinal guide separately from the carriage guide, the tool being separated from the upsetting carriage, and being displaceable in its direction of movement. Further the upsetting tool bears positively against the part of the upsetting carriage acting upon the upsetting tool. This enables the upsetting tool together with its support to be easily removed as a unit for carrying out alterations to the apparatus. Due to the separate arrangement of upsetting tool and driving carriage any refinishing required to be carried out on the parts of the carriage guides will have no deleterious effect on the upsetting process or on the quality of the product. Further advantages are mentioned at the end of the description.

The present invention also relates to the use of the upsetting device according to the invention in a wireworking machine, in particular a nail press used as apparatus for the production of wire nails, in particular headed nails.

BRIEF DESCRIPTION OF THE DRAWINGS

The invention will now be described in detail with reference to a preferred embodiment of the device according to the invention illustrated in the drawing, in which.

DETAILED DESCRIPTION OF THE PREFERRED EMBODIMENT

Figure 2:
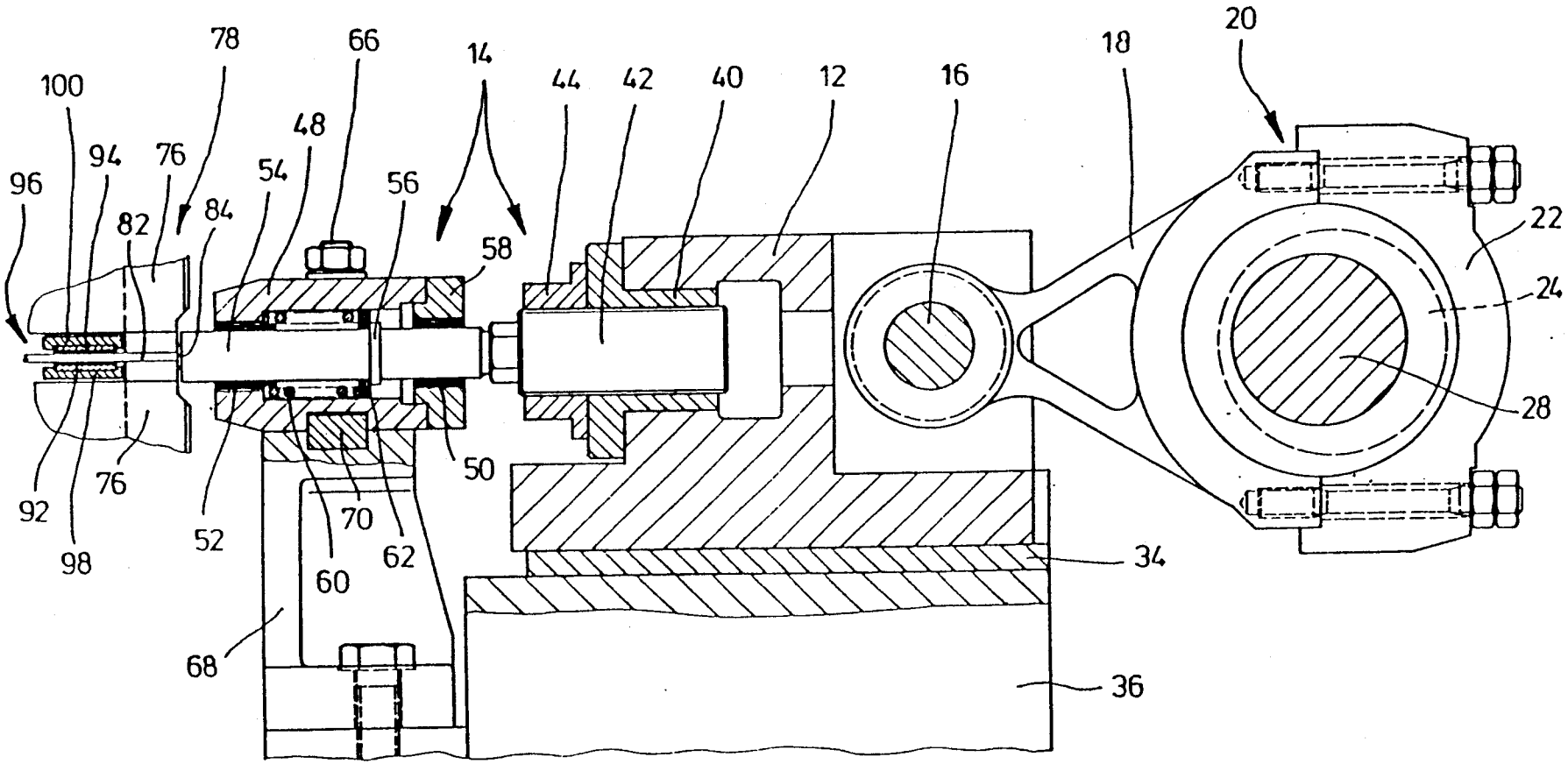
FIG. 2 is a sectional side view of the embodiment.

Referring now to FIG. 2, a carriage (12) of an upsetting device (14) constituting part of an apparatus for the production of wire nails is connected to the connecting link (18) of a connecting rod (20) by a pin (16) seated in the forked end of the carriage (12). This connecting link is held by means of a connecting rod cap on the short stroke crankpin (24) of the drive shaft (28) of the apparatus. The carriage (12), shown in its forward operating position in FIG. 2, has a dovetail guide over its whole length and is mounted to be slidably guided between two guide bars (32) on a baseplate (34) in the machine frame (36). An internally threaded flange (40) is attached to the end of the carriage (12) remote from the connecting link (18) and engages with an adjustment screw (42) which is secured by a ring nut (44).

An upsetting tool (54) of the upsetting device (14) is slidably mounted to be longitudinally displaceable in bearing bushes (50 and 52) in a separate guide (48) in the axial extension to the adjustment screw (42). The bearing bush (50) is pressed into a cover (58) screwed to the guide (48) while the bush (52) is directly seated in the guide (48). A step is turned into the bush (52) at the end of the bush extending into the guide (48). One end of a compression spring (60) bears against this step while the other end of the spring bears against an abutment ring (62) held by a collar (56) of the upsetting tool (54). The guide (48) with its floatingly mounted upsetting tool (54) is mounted on a bearing block (68) on the machine frame (36). where it is adjusted in position by a feather key (70) and secured by two stud bolts (66) so that it can easily be removed or replaced. The return spring (60) presses the upsetting tool (54) into continuous positive contact with the hexagon head of the adjustment screw (42).

Two clamping tools (76) of a clamping device (78) of the apparatus for the production of wire nails, each seated in a lever or carriage and cooperatively moving in opposite directions, are arranged immediately in front of the upsetting tool (54). in the extension of the axis of the latter and symmetrically to this axis.

Figure 1:
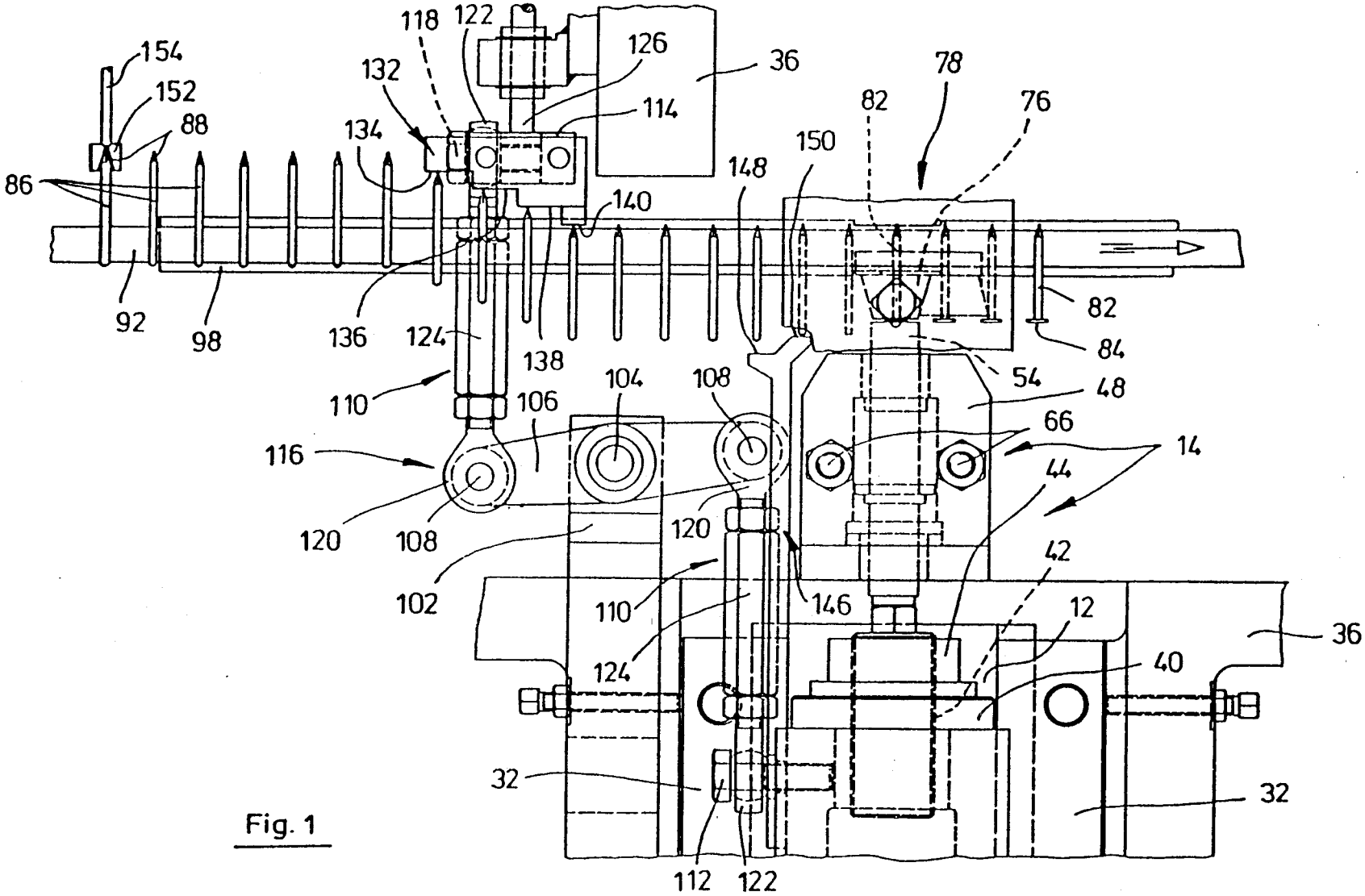
FIG. 1 is a broken top plan view of the embodiment.

In FIG. 1, a wire nail (82) with upset head (84) produced from a nail blank (86) is shown firmly clamped between the clamping tools (76). In FIG. 2, the shank of the wire nail (82) projecting from the clamping tools (76) is firmly clamped in the gaps between the teeth of two toothed belts (92 and 94) of a conveyor device (96) of the apparatus for the production of wire nails. By means of this conveyor device, the nail blanks (86) on which no head (84) is yet formed are moved intermittently towards and away from a position which is exactly central in both the horizontal and vertical plane in front of the upsetting tool (54) of the upsetting device (14) by a stepwise movement of the toothed belts (92 and 94) transversely to the upsetting and clamping direction of the upsetting and clamping device (14,78). The distance between the toothed belts (92 and 94) and hence the tension with which the nail blanks (86) are held in the toothed gaps can be adjusted by means of a vertically adjustable guide rail (98 or 100). Further, lateral supporting surfaces of the guide rails (98 and 100) prevent sideways displacement of the toothed belts (92 and 94) in their movement along their path from a wire cutting device to the upsetting and clamping device.

In FIG. 1, a rocking lever (106) is mounted on a pin (104) in a bearing (1021 fixed to the front part of the guide for the carriage (12). Each arm of this lever (106) is acted upon by a connecting rod (110) by way of a pin (108) so that the rocking lever (106) is coupled at one end thereof to the carriage (12) of the upsetting device (14) by way of a pin (112) and at the other end to a tool holder (114) of a positioning device (116) for the nail blanks (86) by means of a pin (118). Each of the connecting rods (110) has two joint heads (120,122) connected together by a tension lock (124).

The tool holder (114) is supported to be longitudinally displaceable in the machine frame (36) by two rods (126) placed one below the other. The holder (114) carries a positioning tool (132) which has four working surfaces (134 to 140) for a four-stage positioning process during which the longitudinal position of the nail blanks (86) can be altered.

An additional positioning tool (146) longitudinally displaceable in a slot is clamped to the carriage (12) by means of the pin (112) which also fixes the joint head (122). This positioning tool (146) has only two working surfaces (148 and 150) for axially displacing the nail blanks (86) in a direction opposite to that in which the first positioning tool (132) displaced the blanks.

The lower of two cutting tools (152) of the wire cutting device acting against one another for cutting lengths of wire (154) and forming pyramidal tips to the wire blanks (86) is indicated at the very lefthand end of FIG. 1 as part of the apparatus for producing wire nails.

The device described above operates as follows when it forms part of the apparatus (partly illustrated in FIG. 1) for the manufacture of wire nails:

A take-in device known per se but not illustrated draws the wire (154) from the wire supply and through a straightening apparatus and, as shown in FIG. 1, pushes the quantity of wire required for the desired length of nail shank and for forming the nail head (84) through the opened cutting tools (152) and into the gaps between the teeth of the two toothed belts (92 and 94). only one of which belts (92) is shown in FIG. 1. The cooperating cutting tools (152) moving in opposite directions, each of which may be mounted in a lever or in a carriage, now sever the wire (154) in such a manner as to form a pyramidal tip (88) to the wire nail. While the wire (154) is being pushed in between the two toothed belts (92 and 94) and cut off, the intimate drive to the pair of toothed belts (92 and 94) is briefly at a standstill. Thereafter, the drive is briefly switched on again, whereby the pair of toothed belts is moved forwards by one step and the drive is stopped again before a fresh length of wire is fed forwards (a stepping mechanism could be used for this alternating stopping and starting). This process is repeated until a cut length of nail blank (86) lies between the clamping tools (76) of the clamping device (78) and centrally in front of the upsetting tool (54) of the upsetting device (14). In order that the apparatus may be suitable for producing a wide range of lengths of nails without major conversion work in spite of the fact that the cutting tools (152) of the cutting device and the clamping and upsetting device (78,14) of the apparatus for producing wire nails (82) are fixed in position, the difference in the distance between the tip (88) of a wire nail and the upsetting tool (54) when producing nails of a different length is compensated for by displacing the nail blanks (86) in their longitudinal direction within the conveyor path between the cutting station and the station for forming the head by upsetting. This is carried out as follows:

The nail blanks (86) are positioned by the two positioning tools (132 and 146) of the positioning device (116). the first tool (132) having four working surfaces (134 to 140) for pushing the nails forward stepwise. The stepwise positioning takes place with each forward stroke of the carriage (12). During the forward movement of the carriage (12), i.e. during the formation of each nail head (84), the positioning tool (132) which is supported in the machine frame (36) is moved towards the conveyor device (96) by way of the connecting rod (110) and the rocking lever (106) so that the nail blank (86) which at that moment is in front of the first working surface (134) of the positioning tool (132) is pushed forwards by a certain amount. As already mentioned, the conveyor device (96) is at a standstill at this stage. While the carriage (12) is moving backwards, the drive is briefly switched on for a period of transport so that the nail blank (86) which has previously been pushed forwards by the working surface (134) of the tool (132) is now brought in front of the second working surface (136) and is pushed forwards by the same amount during a fresh upsetting operation. These movements are repeated until the nail blank (86) has been pushed into its furthest forward position by the fourth working surface (140) of the positioning tool (132). When the nail blank (86) is in this longitudinal position, it is carried stepwise in the direction towards the upsetting station until it lies in front of the working surface (150) of the second positioning tool (146). The nail blank (86) may now if necessary be moved slightly backwards by the working surface (150) to compensate for tolerances in the lengths of the blanks so that the blank can take up its final position. This movement is also derived from the upsetting movement of the carriage (12) and in the example illustrated here the nail blank is brought into such a position between the clamping tools (76) after two phases of transport that the length of wire projecting from the clamping jaws (76) is exactly the amount required for forming the head (84) of the wire nail. If the nail blanks (86) are exceptionally long, their displacement backwards by the second positioning tool (146) takes place in two stages, the blank being first moved back by the working surface (148) and thereafter into its final position by the working surface (150).

The positioning device (114) may obviously be dispensed with completely when producing only nails of one length or when great accuracy in the length of the nails is not required. In such cases, the cutting device is so arranged that when the nail blanks (86) are placed in the conveyor device (96), the length of wire projecting from the clamping tools (76) is exactly that required for producing the head of the nail in the upsetting process.

When the clamping jaws (76) close up, they firmly hold the blank (86) in position for the upsetting process which now follows for producing the head (84) of the nail. For this purpose, the link (18) of the connecting rod is set in motion by the (short stroke) crankpin (24) of the drive shaft (28) to impart a reciprocating movement to the carriage (12). The upsetting tool (54), which is connected non-positively to the hexagon of the adjustment screw (42) by the restoring spring (60), participates in this reciprocating movement and with each forward movement it produces a head (84) on a nail blank (86), the clamping tools (76) serving as anvil. With each backward movement of the carriage (12). the compression spring (60) relaxes and pushes the upsetting tool (54) back by way of the abutment ring (62) on the collar (36) of the upsetting tool (54) so that the latter remains in permanent frictional contact with the adjustment screw (42). The magnitude of the upsetting pressure(and hence also the form of the nail head) may be adjusted by turning the adjustment screw (42) in the threaded flange (40) of the carriage (12) by varying amounts.

One complete wire nail (82) is moved out of the range of the tools with each transport step while a fresh nail blank (86) arrives between the tools (54 and 76) and the process then begins again from the beginning. After several transport phases, the completed nails (82) are securely discharged at the end of the conveyor path over a chute without the aid of a special ejector device, or alternatively, the completed nails arriving in a row may be automatically removed singly for storage or other processing and carried away.

Due to the fact that the upsetting tool (54) is arranged in a separate guide (48) and not positively connected with the carriage (12). the upsetting tool (54) together with its guide (48) can easily be removed as a unit by simply unscrewing the nuts of the stud pins (66) and exchanged if necessary, and the clamping tools (76) are readily accessible for replacement after this unit has been removed.

Another advantage of this sleeve mounted arrangement of upsetting tool outside the carriage (12) is the long circular guidance provided, which extends over a relatively great part of the length of the tool on both sides so that the tool is mounted without clearance and without tilting.

Further, the upsetting pressure need not, as hitherto, be taken up by the carriage (12) and its guide bars (32,34) which had to be replaced as a whole when wear became excessive. In the known arrangement, where the carriage and upsetting tool were not separate, the inaccuracy resulting from increasing wear of the carriage and of the guide parts, i.e. from progressively greater clearance between the guide and the parts guided, was transmitted to the end product so that constant monitoring of the machine was necessary to avoid the production of rejects. Moreover, the operation of the machine became progressively louder as the clearance increased.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An upsetting device for upsetting the ends of elongated workpieces such as wire pieces, in particular for the production of heads on nails, comprising:

an upsetting tool movable forward by means of an upsetting carriage provided with a carriage guide and having a part acting directly on said upsetting tool, said part adapted to be movable backwards;

said upsetting tool being mounted and displaceable separately from said upsetting carriage in a longitudinal guide separate from said carriage guide;

said upsetting tool being displaceable in its direction of movement; wherein said upsetting tool bears continuously and positively against said part of said upsetting carriage acting upon said upsetting tool; and a positioning device comprised of first and second positioning tools for arranging the workpieces in opposite directions along their axes, said positioning device coupled to said upsetting tool.

2. An upsetting device for upsetting the ends of elongated workpieces such as wire pieces, in particular for the production of heads on nails, comprising:

an upsetting tool movable forward by means of an upsetting carriage provided with a carriage guide and having a part acting directly on said upsetting tool, said part adapted to be movable backwards;

said upsetting tool being mounted and displaceable separately from said upsetting carriage in a longitudinal guide separate from said carriage guide;

said upsetting tool being displaceable in its direction of movement; wherein said upsetting tool bears continuously and positively against said part of said upsetting carriage acting upon said upsetting tool; and a positioning device for arranging the workpieces along their axes, said positioning device comprising at least one first positioning tool for displacing at least one workpiece by a predetermined amount in its longitudinal direction, wherein said first positioning tool is coupled to said upsetting carriage for a rectilinear, unidirectional movement in the opposite direction; and wherein said first positioning tool and said upsetting carriage are coupled by means of a two-armed lever which is rotatably mounted on a bearing rigidly connected to said carriage guide and by means of two link rods each connecting one lever arm to said first positioning tool and said upsetting carriage, respectively; wherein a second positioning tool is mounted on said upsetting carriage so as to be adjustable in the direction of its stroke.

* * * * *